US008092192B2

(12) United States Patent
Lo et al.

(10) Patent No.: US 8,092,192 B2
(45) Date of Patent: Jan. 10, 2012

(54) WIND-POWER WATER SUPPLY PUMP

(76) Inventors: An-Shun Lo, Shulin (TW); Ying-Po Hsieh, Yingge Town (TW)

( * ) Notice: Subject to any disclaimer, the term of this patent is extended or adjusted under 35 U.S.C. 154(b) by 493 days.

(21) Appl. No.: 12/427,770

(22) Filed: Apr. 22, 2009

(65) Prior Publication Data

US 2010/0272579 A1 Oct. 28, 2010

(51) Int. Cl.
*F04B 17/02* (2006.01)
*F04B 49/00* (2006.01)

(52) U.S. Cl. ..... 417/47; 417/334; 290/55

(58) Field of Classification Search ..... 417/334, 417/336, 492, 493, 521, 405; 290/52, 55
See application file for complete search history.

(56) References Cited

U.S. PATENT DOCUMENTS

2010/0320770 A1* 12/2010 Dahlhaug ..... 290/55
* cited by examiner

*Primary Examiner* — Joseph L Williams
*Assistant Examiner* — Elmito Breval
(74) *Attorney, Agent, or Firm* — Leong C. Lei

(57) ABSTRACT

A wind-power water supply pump includes a housing, a rotary disk, a vane wheel, a direction control vane, a linkage, and a plurality of expandable tubes, wherein the rotary disk is rotatably mounted to a top of the housing and the vane wheel and the direction control vane are symmetrically arranged on opposite sides of the rotary disk. The vane wheel is set in driving coupling with the linkage. The vane wheel, when rotated by winds, drives repeated expansion/compression of the expandable tube. The change of the volume of the expandable tube is used to deliver water so that the consumption of human labor and additional power supply that are used to deliver water in areas where power is not readily acquired but wind power is available can be cut down.

10 Claims, 7 Drawing Sheets

WIND-POWER WATER SUPPLY PUMP

TECHNICAL FIELD OF THE INVENTION

The present invention generally relates to a water supply pump that uses wind power to deliver water, which is particular fit for use in area where commercial power supply is not readily acquired but plenty of wind power is available.

DESCRIPTION OF THE PRIOR ART

The nature provides various renewable energies, including wind energy solar energy, tidal power, and geothermal energy. All these renewable energies can be cyclically used and are clean and causes no pollution to the natural environments when consumed.

Among these renewable energies, wind energy is easy to use and is non-exhaustible and is particularly good for areas where wind resources are readily available, such as offshore islands and wide open fields. The wind energy is extracted from moving airflows, namely winds, and the generation of winds is a movement of air due to convection caused by nonuniform heating of the atmosphere. Thus, it is can be regarded as a form of energy supplied by the Sun. It is often used to drive mechanical devices, such as a sailboat or a windmill.

In large spans of grass field or range, wind power is often used to carry out jobs that are allowed to interrupted, such as driving a windmill to pump water into agricultural fields (water delivery) or to grind crops and it is also used to drive a dynamo for generating electricity for lighting and communication purposes. However, the conventional windmill is constructed with a great number of parts and is very bulky, making the construction and installation very difficult. Further, air streams that supply wind power also bring in dust and sand, which might get accumulated at joints of the windmill, making the operation of the windmill unsmooth or causing damages of the parts, and also leading to problem for maintenance. On the other hand, delivery of water is often done with a water pump. However, the conventional water pump is operated with energy that is supplied from electricity and water is drawn in, pumped forward, and compressed by the centrifugal force caused by high speed operation of the water pump. When the water pump is rotated at a low speed, the performance thereof cannot be exploited to deliver water. Further, for delivery of water in a long distance, or for delivery of a large amount of water in a very short period, since it is generally not possible to connect two or more water pumps to carry out pumping operation, it often overload a single water pump to achieve the desired delivery operation. This leads to increase of delivery expense and cannot effectively reduce power consumption.

Thus, the present invention aims to provide a novel wind-power water supply pump, which uses wind energy as a power source and is operable without suction induced by centrifugal force generated by high speed rotation, and which is operated by using winds to rotate a vane wheel that in turn drives a linkage to actuate repeated expansion/compression of an expandable tube for inducing suction force for delivery of water. This is particularly good for areas where long distance delivery of water is required or where no electricity is available.

SUMMARY OF THE INVENTION

An objective of the present invention is to provide a wind-power water supply pump, which effectively cut down the consumption of human labor and additional power supply for delivery of water in zones where the power supply cannot be obtained but wind power is readily available.

Another objective of the present invention is to provide a wind-power water supply pump, which is built up with structure-simplified parts to thereby substantially reduce the costs for manufacture and maintenance.

To achieve the above objectives, in accordance with the present invention, a wind-power water supply pump is provided, comprising a housing, a rotary disk, a vane wheel, a direction control vane, a linkage, and a plurality of expandable tubes, wherein the rotary disk is rotatably mounted to a top of the housing and the vane wheel and the direction control vane are symmetrically arranged on opposite edges of the top of the rotary disk. The vane wheel is coupled to the linkage and the linkage has ends respectively connected to the expandable tubes to establish driving coupling between the vane wheel and each expandable tube in order to drive repeated expansion/compression of the expandable tube. The expandable tube is arranged to have an end thereof in communication with a water source and an opposite end in communication with a water supply destination.

Thus, the water supply pump of the present invention is installed in an area where electrical power is not available but a plenty of wind power can be readily obtained. The vane wheel, when rotated by winds, drive the expandable tube to alternately contract and expand via the linkage coupled therebetween for delivering water. For example, when the expandable tube is expanded by being stretched, an internal volume of the expandable tube is increased and a suction force is induced to draw water into the expandable tube; and on the other hand, when the expandable tube is contracted by being compressed, the internal volume of the expandable tube is decreased and an expulsion force is induced to expel the water that is stored inside the expandable tube. The present invention takes advantage of the volume variation of the expandable tube caused by expansion/contraction thereof to deliver water and wind power is thus converted into work for moving the water. This substantially cuts down the consumption of human labor and other externally supplied power in delivering water. Further, since the components of the water supply pump of the present invention are made modularized, the number of components is reduced and the overall size is decreased, thereby remarkably lowering the manufacturing cost. Further, except a vane wheel and a direction control vane, all the other components of the water supply pump of the present invention are enclosed in a housing and are thus protected against damage caused by dust and sand attached thereto, alleviating wear of the components. The expandable tube is strengthened with respect to both toughness and strength, so that the service life can be substantially extended and the maintenance expense is reduced.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
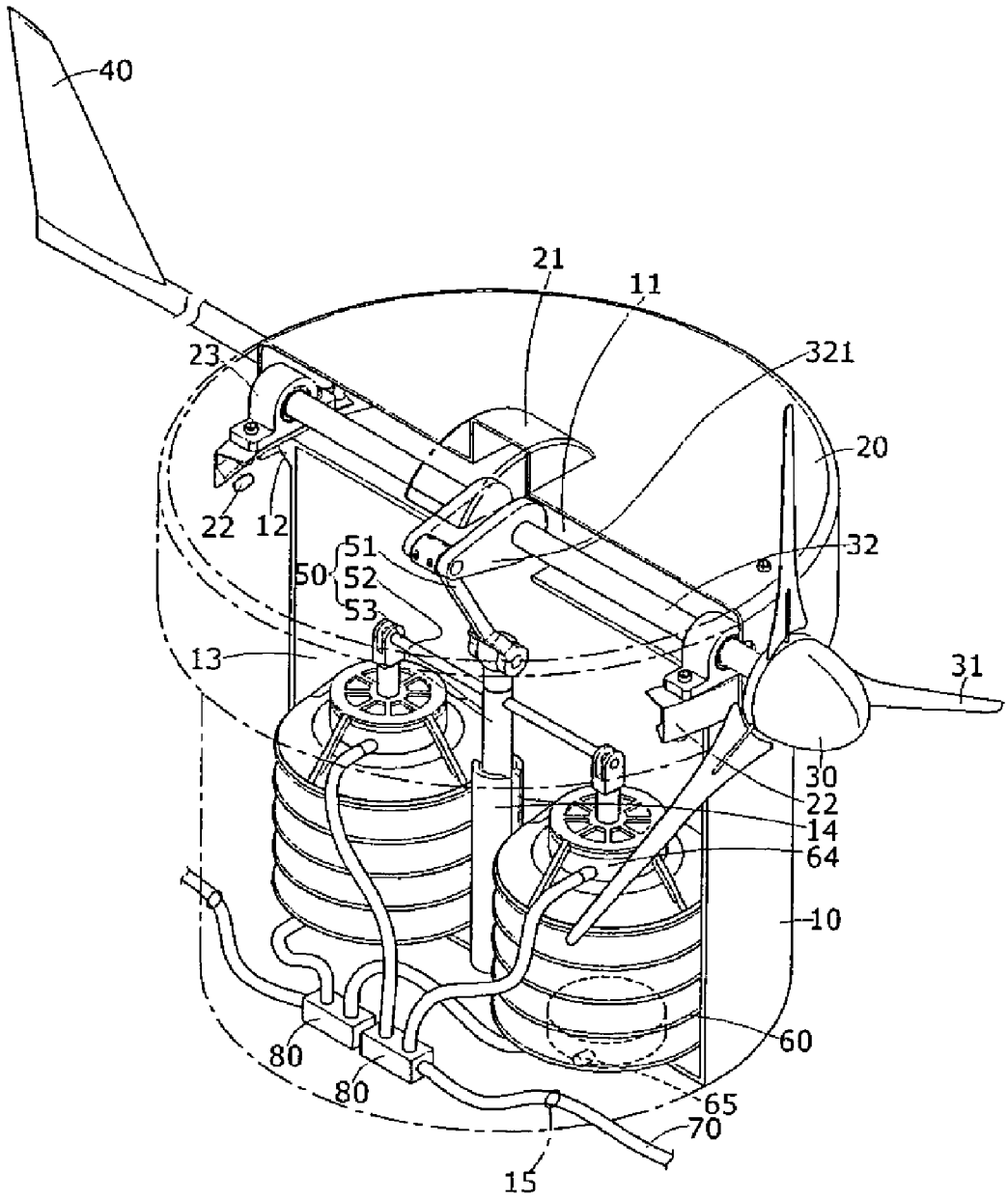
FIG. 1 is a perspective view, partly broken, of a water supply pump constructed in accordance with a preferred embodiment of the present invention.
Figure 2:
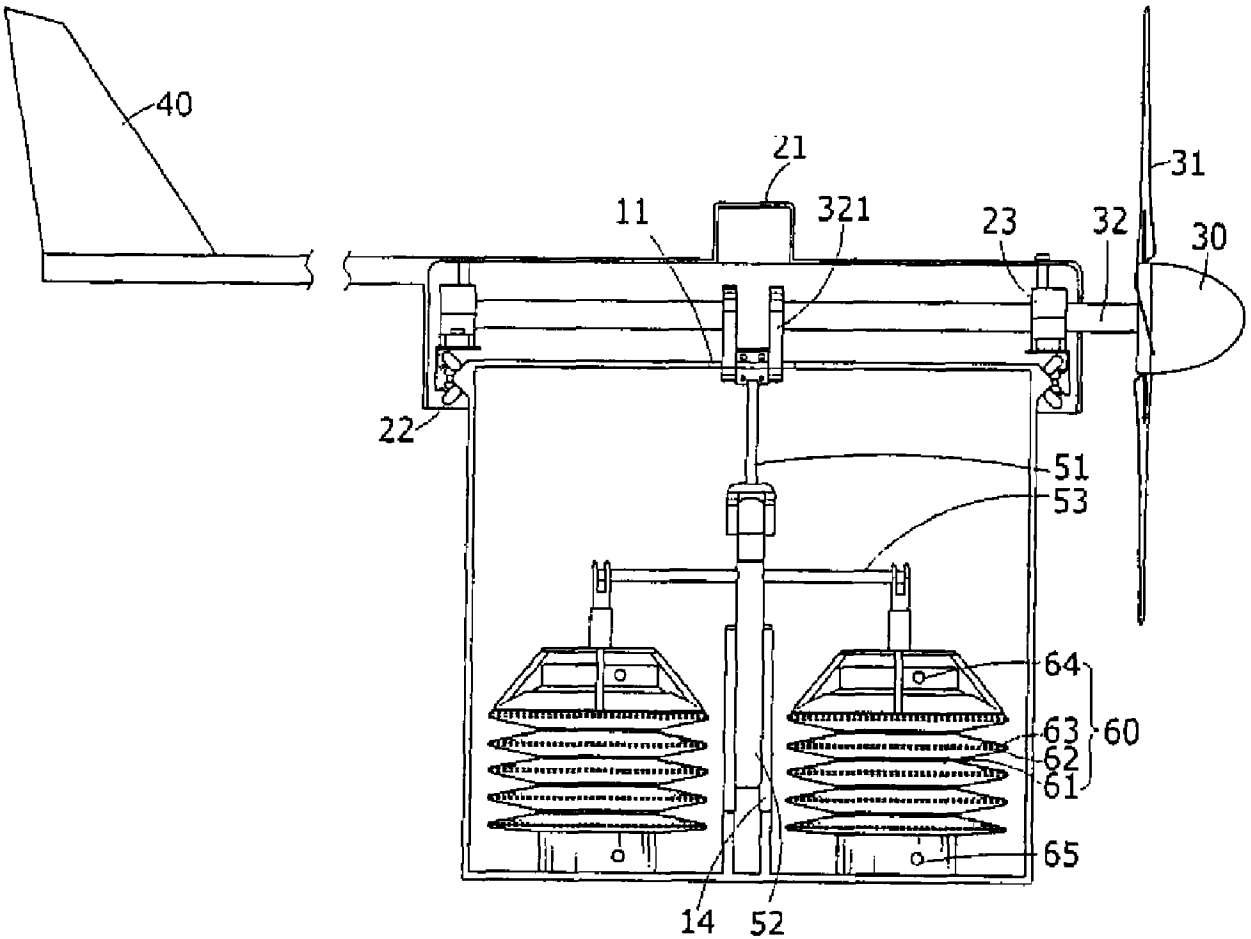
FIG. 2 is a cross-sectional view of the water supply pump of the present invention in an assembled condition.
Figure 3:
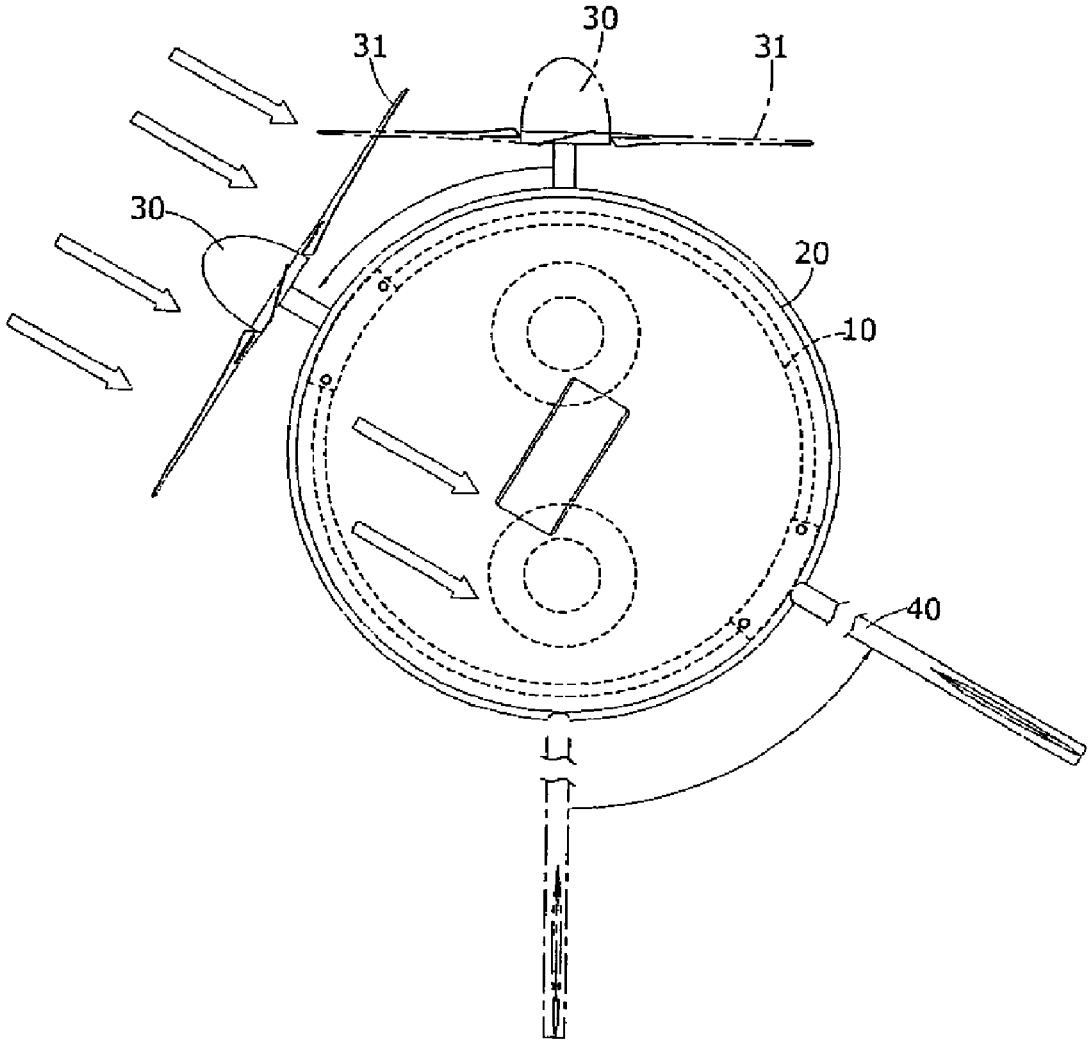
FIG. 3 is a schematic view illustrating the rotation of a rotary disk of the water supply pump of the present invention in accordance with the blowing direction of winds applied thereto.

With reference to the drawings and in particular to FIGS. 1-3, which shows a wind-power water supply pump in accordance with a preferred embodiment of the present invention, the wind-power water supply pump of the present invention comprises the following constituent components/assemblies:

A housing 10, which is in a cylindrical form, has a top forming an opening 11. The opening 11 has a circumference along which a flange 12 is provided to form a circular track. The housing 10 defines an interior receiving chamber 13 and a hollow positioning cylinder 14 is arranged at a central location inside the receiving chamber 13. Further, the housing 10 has an outer surface forming through holes 15 for receiving water pipes 70 extending therethrough.

A rotary disk 20, which is in the form of a circular disk, is movably mounted around the circumference of the opening 11 of the housing 10. The rotary disk 20 forms, at a center thereof, a projection 2. The rotary disk 20 has a bottom having a circumference to which a plurality of roller sets 22 is mounted for movably claming the flange 12, so as to allow the rotary disk 20 to carry out reciprocal circumferential rotation on the top of the housing 10. Further, the rotary disk 20 has a top to which two bearing seats 23 are mounted. The two bearing seats 23 are arranged on opposite sides of the central projection 21 in a symmetric manner.

A vane wheel 30 comprises a plurality of blades 31 distributed along a circumference thereof and a shaft 32 set at a center thereof. The shaft 32 is movably received through the two bearing seats 23. An eccentric block 321 is mounted to a middle section of the shaft 32. The vane wheel 30, when driven by winds, causes continuous rotation of the shaft 32 and the eccentric block 321.

A direction control vane 40 is arranged on the bearing seat 23 opposite to the vane wheel 30 in order to keep the direction control vane 40 in direction with the winds, whereby when the direction of winds forms an angle with respect to the direction control vane 40, the winds drive the direction control vane 40 to cause rotation of the rotary disk 20.

A linkage 50 is arranged inside the housing 10. The linkage 50 comprises a connection bar 51, a transmission bar 52, and at least one coupling bar 53. The connection bar 51 has an end connected to the eccentric block 321 of the vane wheel 30 and an opposite end pivotally connected to an end of the transmission bar 52. An opposite end of the transmission bar 52 is coupled with the coupling bar 53. The transmission bar 52 is movably received in the positioning cylinder 14 inside the housing 10, whereby when the vane wheel 30 rotates, the connection bar 51 is driven to carry out reciprocal up and down movement, while the transmission bar 52 is subjected to restriction by the positioning cylinder 14 to only cause limited reciprocal up and down movement of the coupling bar 53.

A plurality of expandable tubes 60 is coupled to ends of the coupling bar 53 respectively. Each expandable tube 60 is formed by tightly stacking multiple layers made of resilient material having toughness and has an outer surface successively forming alternating troughs 61 and ridges 62. A reinforcing ring 63 is set between adjacent trough 61 and ridge 62. The expandable tube 63 has a top forming, at a central location thereof, a water inlet hole 64 and a bottom forming, at a central location thereof, a water outlet hole 65. Preferably, the water inlet hole 64 and the water outlet hole 65 are of the same size and same shape. Further the water inlet hole 64 is structured to allow water to flow in but prevent water from flowing out, while the water outlet hole 65 is of a structure that allows water outflow but prevents water inflow. Such an arrangement ensures protection of the pump against reverse water flow that is unexpectedly caused in delivering water.

Figure 4:
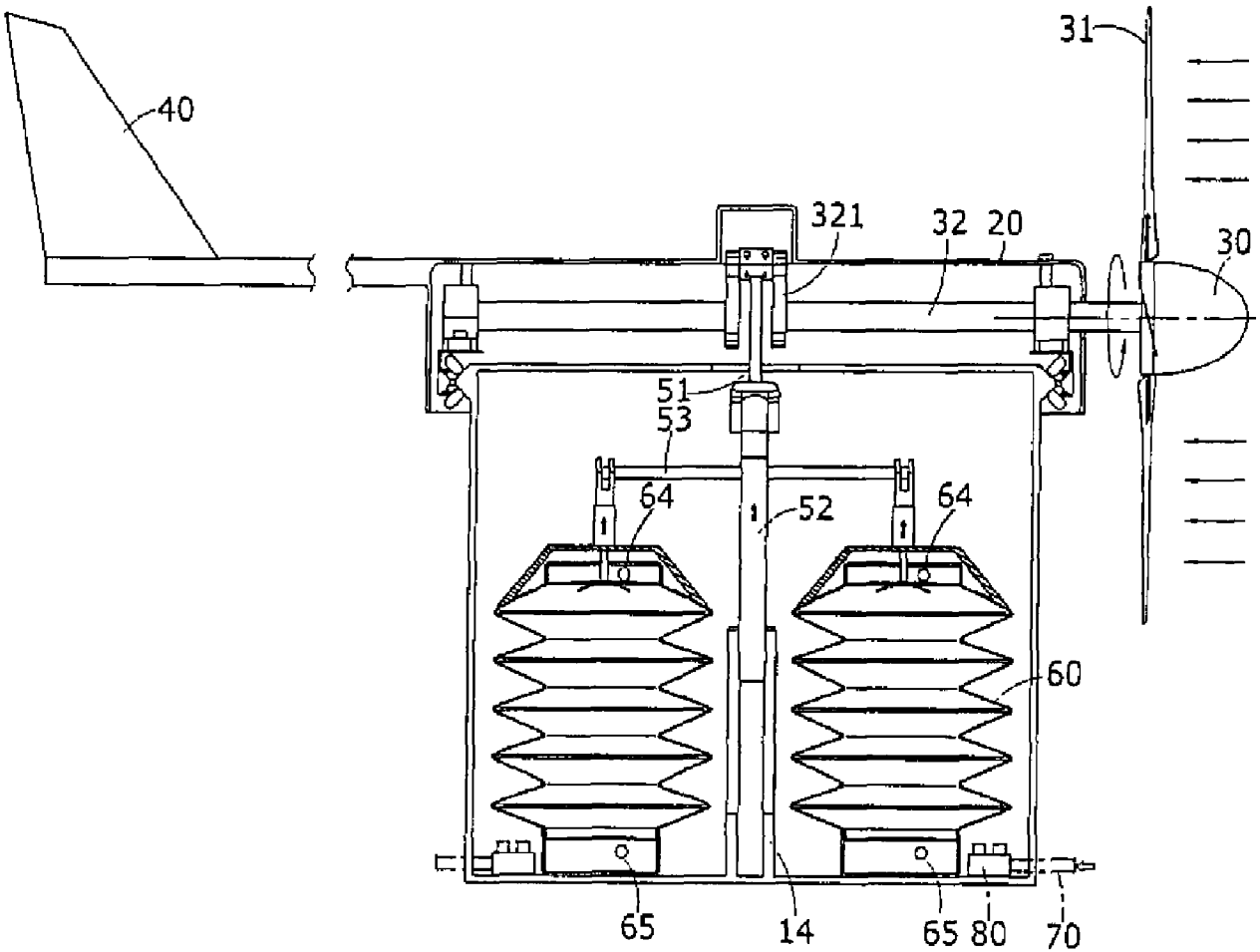
FIG. 4 is a cross-sectional view illustrating the operation of the water supply pump in accordance with the present invention.
Figure 5:
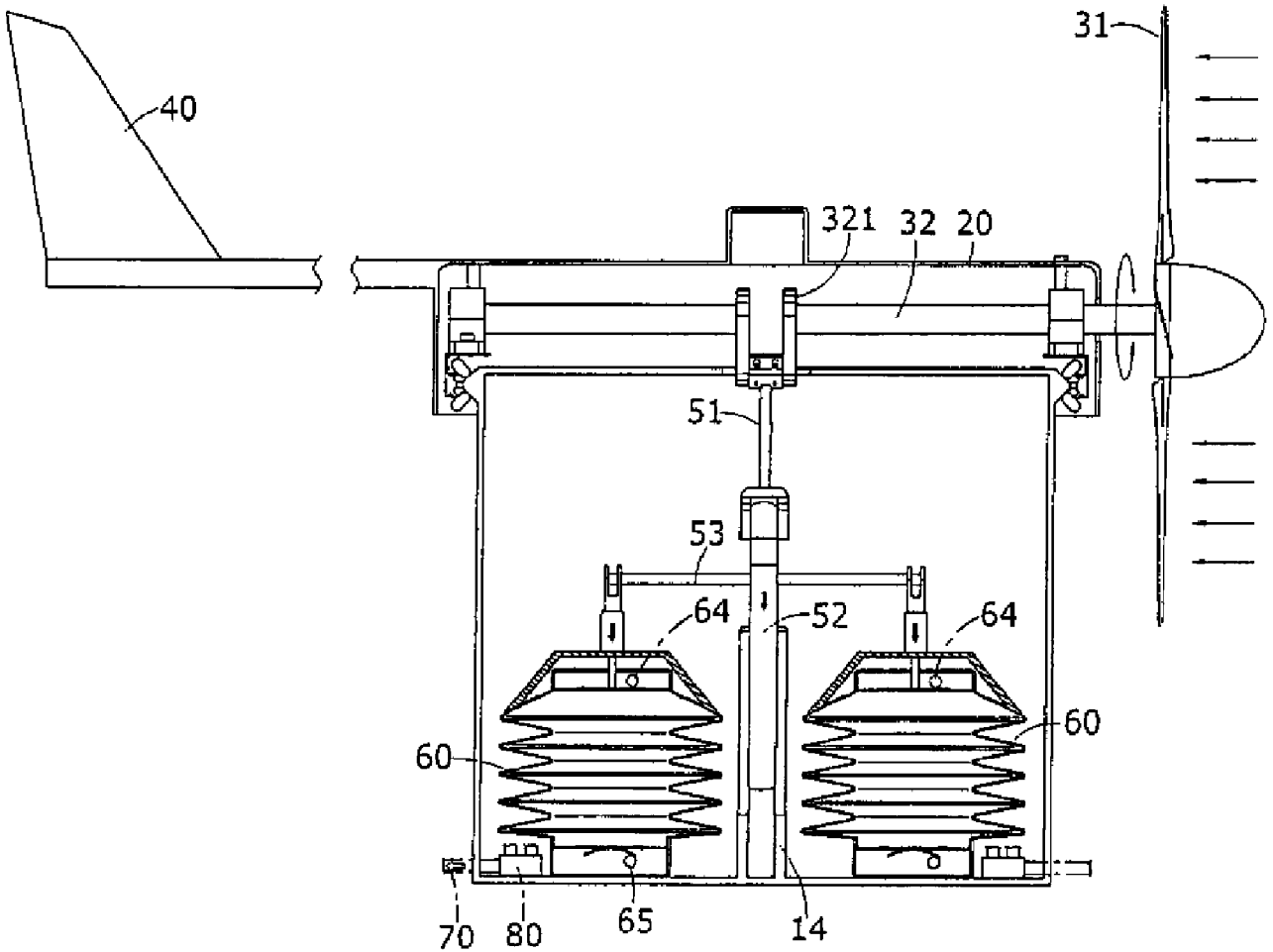
FIG. 5 is another cross-sectional view illustrating the operation of the water supply pump in accordance with the present invention.

To use, the water supply pump of the present invention is installed in an area where electrical power is not available but a plenty of wind power can be readily obtained. As shown in FIGS. 1 and 3-5, the water pipes 70 extending into the housing 10 are respectively connected through fittings 80 to the water inlet hole 64 and water outlet hole 65 of each expandable tube 60. The water pipe 70 connected to the water inlet hole 64 is set in communication with a water source, while the water pipe 70 connected to the water outlet hole 65 is extended to a water supply destination. Since the direction control vane 40 of the water supply pump of the present invention, when subjected to drive by winds, can automatically cause the rotary disk 20 to rotate, making the blades 31 of the vane wheel 30 maintaining in direction with the incoming winds, there always maintains the maximum wind reception surface. When the blades 31 of the vane wheel 30 is rotated by the wind power, the shaft 32 of the vane wheel 30 is caused to continuously rotate and the eccentric block 321 of the shaft 32 drives the reciprocal up and down movement of the connection rod 51, which in turn reduces the transmission bar 52 and the coupling bar 53 to reciprocally move up and down, forcing the expandable tube 60 coupled to the end of the coupling bar 53 alternately contract and expand by which action water is delivered from the water source to the water supply destination. As shown in FIG. 3, when the expandable tube 60 is expanded by being stretched by the coupling bar 53, an internal volume of the expandable tube 60 is increased and a suction force is induced to draw water into the water inlet hole 64 and accumulated inside the expandable tube 60. As shown in FIG. 4, on the other hand, when the expandable tube 60 is contracted by being compressed by the coupling bar 53, the internal volume of the expandable tube 60 is decreased and an expulsion force is induced to expel the water that is stored inside the expandable tube 60. The present invention takes advantage of the volume variation of the expandable tube 60 caused by expansion/contraction thereof to deliver water and wind power is thus converted into work for moving the water. This substantially cuts down the consumption of human labor and other externally supplied power in delivering water. Further, since the component of the water supply pump in accordance with the present invention, such as the vane wheel 30, the linkage 50, and the expandable tube 60, is made modularized, the number of components is reduced and overall size is decreased, thereby remarkably lowering the manufacturing cost. Except the vane wheel 30 and the direction control vane 40, all the other components of the water supply pump of the present invention are enclosed in the housing 10 and are thus protected against damage caused by dust and sand attached thereto, alleviating wear of the components. The expandable tube 60 is comprised of multiple layers of material of toughness, which provides sufficient tensile and/or compression strength; this together with the arrangement of the reinforcing ring 63, effectively protects the expandable tube 60 against excessive internal pressure. Thus, the service life can be substantially extended and the maintenance expense is reduced.

Figure 6:
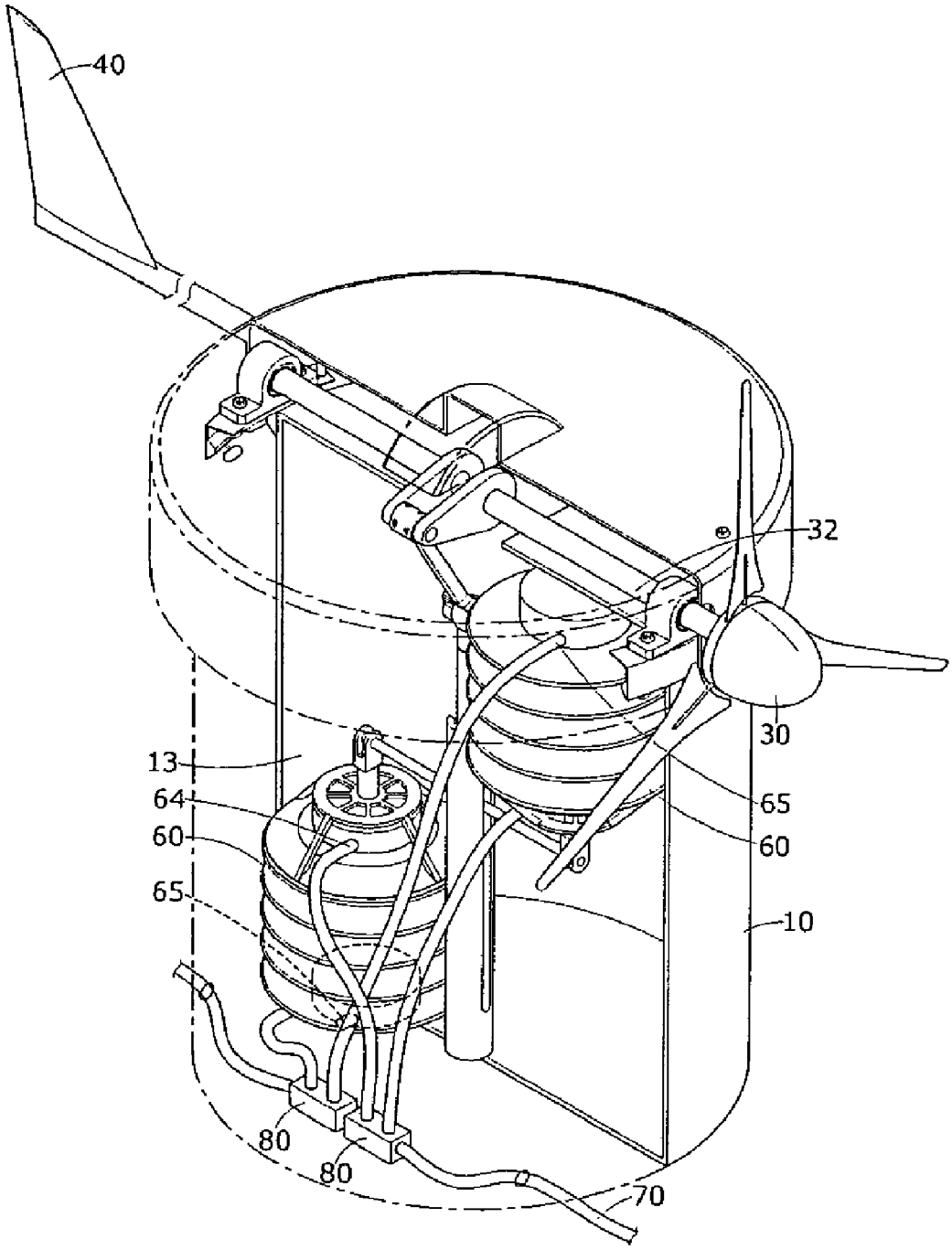
FIG. 6 is a perspective view, partly broken, of a water supply pump constructed in accordance with another embodiment of the present invention.
Figure 7:
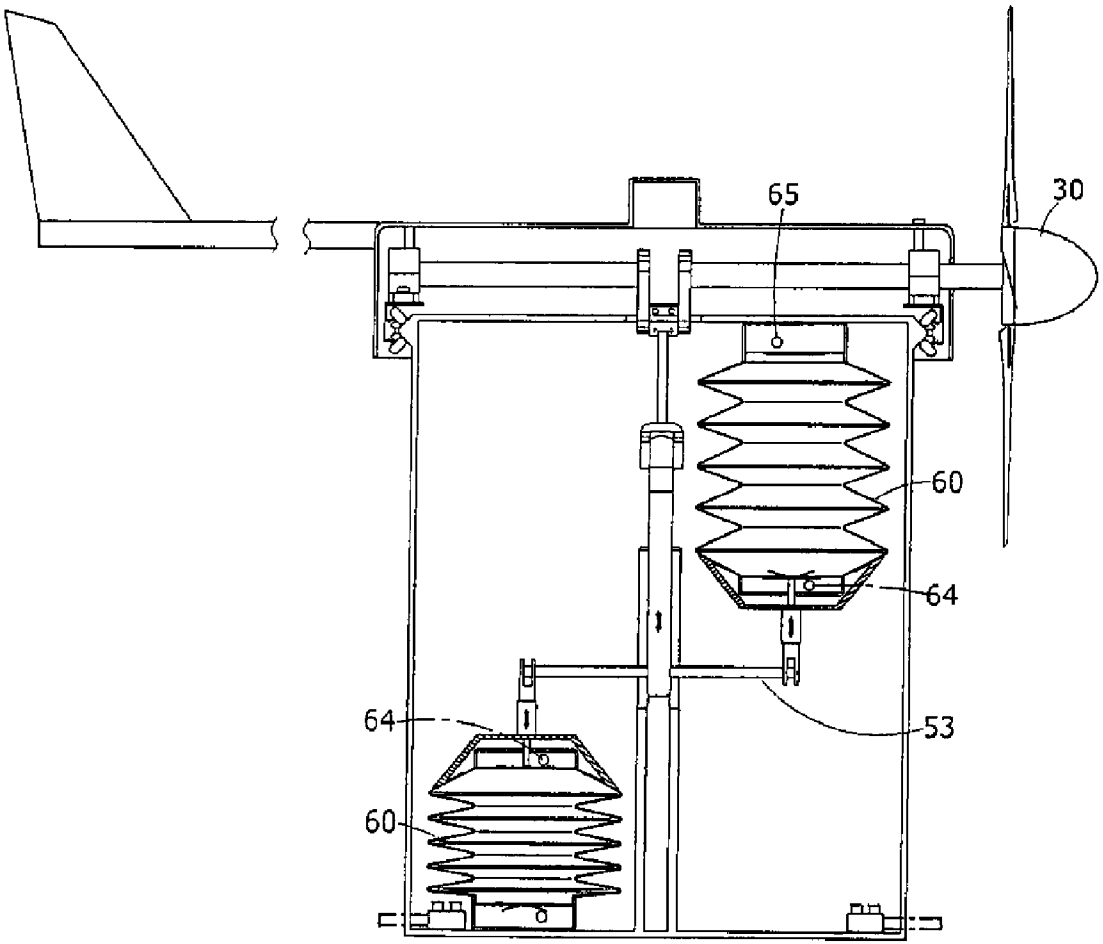
FIG. 7 is a cross-sectional view illustrating the operation of the water supply pump in accordance with said another embodiment of the present invention.

Referring to FIGS. 6 and 7, a water supply pump in accordance with another embodiment of the present invention is illustrated, wherein two expandable tubes 60 are coupled to opposite ends of the coupling bar 53 but in an opposite manner, so that one of the expandable tubes 60 is oriented to have the water inlet hole 64 at a vertically upper side and the water outlet hole 65 at a vertically lower side, while the other one of the expandable tubes 60 is oppositely oriented to have the water inlet hole 64 at the vertically lower side and the water outlet hole 65 at the vertically upper side. When the coupling bar 53 moves upward, said one of the expandable tubes 60 is stretched, while said other one of the expandable tubes 60 is compressed. On the other hand, when the coupling bar 53 moves downward, said one of the expandable tubes 60, which was previously stretched, is compressed, while said other one of the expandable tubes 60, which was previously compressed, is stretched. Thus, with the reciprocal vertical movement of the coupling bar 53, the two expandable tubes 60 are always maintained in such a way that one is stretched and the other is compressed, allowing water to be continuously delivered when the vane wheel 30 is operated by the wind power. In this way, the efficiency of delivering water is enhanced and the practicability is improved.

As shown in FIGS. 1-7, the present invention offers the following advantages:

(1) The present invention uses the rotation of the vane wheel 30 subjected to wind power to drive the linkage 60 for repeatedly expand/compress the expandable tube 60, and the change of the internal volume of the expandable tube 60 is utilized to actuate the delivery of water, whereby human labor and commercial power supply are substantially reduced for delivering water in an area where commercially supplied power is not readily accessed, but plenty of wind power is available and convenience of use is improved.

(2) The present invention uses vane wheel 30, linkage 50, and expandable tube that are all of modularized constructions so that the number of components is reduced, the overall size is decreased, and thus the manufacturing costs are remarkably lowered down.

(3) The components of the present invention are enclosed in a housing 10 to be protected against damage caused by dust and sand attached thereto, thereby alleviating wear of the components and extending service lives thereof.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A wind-power water supply pump, comprising:

a housing forming a top opening and having a circumference forming a flange, the housing comprising a hollow positioning cylinder arranged centrally therein;

a rotary disk movably mounted on the top of the housing and forming a central through hole, the rotary disk having a bottom having a circumference to which a plurality of roller sets is mounted to allow the rotary disk to carry out reciprocal circumferential rotation, the rotary disk having a top to which two bearing seats are mounted;

a vane wheel movably mounted to the rotary disk and having a plurality of blades, the vane wheel comprises a central shaft movably received through the two bearing seats, an eccentric block mounted to a middle section of the shaft, the vane wheel being adapted to be driven by winds for causing continuous rotation of the shaft and the eccentric block;

a direction control vane arranged on the bearing seat opposite to the vane wheel, the direction control vane keeping in direction with the winds to cause rotation of the rotary disk in accordance with the winds;

a linkage arranged inside the housing and comprising a connection bar, a transmission bar, and at least one coupling bar, the connection bar having an end connected to the eccentric block and an opposite end pivotally connected to an end of the transmission bar, an opposite end of the transmission bar being coupled with the coupling bar, the transmission bar being movably received in the positioning cylinder; and a plurality of expandable tubes coupled to ends of the coupling bar and each having an outer surface forming alternating troughs and ridges, a reinforcing ring being set between adjacent trough and ridge, the expandable tube having a top forming centrally a water inlet hole and a bottom forming centrally a water outlet hole.

2. The wind-power water supply pump according to claim 1, wherein the housing is cylindrical and the rotary disk is circular.

3. The wind-power water supply pump according to claim 1, wherein the housing has a top that forms the top opening and the circumference thereof around the top opening forms the flange that is in the form of a circular track, and wherein the housing defines an interior receiving chamber in which at least one support rack.

4. The wind-power water supply pump according to claim 1, wherein the housing has a surface forming through holes for accommodating water pipes.

5. The wind-power water supply pump according to claim 1, wherein the two bearing seats are set at locations that are on opposite sides of and are symmetric with respect to the central through hole.

6. The wind-power water supply pump according to claim 1, wherein the expandable tube comprises a multiple stacked layers made of resilient material having toughness, the reinforcing ring being enclosed in the resilient material.

7. The wind-power water supply pump according to claim 1, wherein the water inlet hole and the water outlet hole of the expandable tube are of the same size and same shape.

8. The wind-power water supply pump according to claim 1, wherein the water inlet hole and the water outlet hole are respectively connected to water pipes.

9. The wind-power water supply pump according to claim 1, wherein the expandable tube that is coupled to an end of the coupling bar is arranged in such an orientation that the water inlet hole is at a vertically upper side and the water outlet hole is at a vertically lower side.

10. The wind-power water supply pump according to claim 1, wherein two expandable tubes are coupled to the coupling bar in such a way to be opposite to each other so that one of the expandable tubes is oriented to have the water inlet hole at a vertically upper side and the water outlet hole at a vertically lower side, while the other one of the expandable tubes is oppositely oriented to have the water inlet hole at the vertically lower side and the water outlet hole at the vertically upper side.

* * * * *